US008827742B2

(12) United States Patent
Wang

(10) Patent No.: US 8,827,742 B2
(45) Date of Patent: Sep. 9, 2014

(54) WATERPROOF ELECTRICAL CONNECTOR

(71) Applicant: Fei Wang, Shenzhen (CN)

(72) Inventor: Fei Wang, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 73 days.

(21) Appl. No.: 13/716,225

(22) Filed: Dec. 17, 2012

(65) Prior Publication Data

US 2013/0183844 A1 Jul. 18, 2013

(51) Int. Cl.
*H01R 13/648* (2006.01)

(52) U.S. Cl.
USPC ..... 439/569; 439/607.37

(58) Field of Classification Search
USPC ..... 439/607.37, 607.35, 607.36, 569, 570
See application file for complete search history.

(56) References Cited

U.S. PATENT DOCUMENTS 4,721,473 A * 1/1988 DelGuidice et al. ..... 439/79
5,961,347 A * 10/1999 Hsu ..... 439/570
6,824,425 B2 * 11/2004 Fan ..... 439/570
7,074,085 B2 * 7/2006 Chen ..... 439/607.36
7,182,641 B2 * 2/2007 Shimoyama ..... 439/607.35
7,785,149 B2 * 8/2010 Kamata et al. ..... 439/607.35
8,454,387 B2 * 6/2013 Peng et al. ..... 439/607.35
2013/0344734 A1 * 12/2013 Yokoyama et al. ..... 439/569

FOREIGN PATENT DOCUMENTS

TW M411033 9/2009
WO 2011108679 9/2011

* cited by examiner

*Primary Examiner* — Gary Paumen
(74) *Attorney, Agent, or Firm* — Wei Te Chung; Ming Chieh Chang

(57) ABSTRACT

An electrical connector (100) includes a metallic shell (1), an insulative housing (2) combined to the metallic shell, a plurality of terminals (3) retained in the insulative housing, an insulative cover (5) covering the metallic shell, a waterproof ring (7) and a waterproof plate (8) respectively attached to a front end and a rear face of the insulative cover, and a fixing member (6) attached to the insulative cover. The fixing member includes a rectangular portion (61), at least one corner portion (62) bending from the rectangular portion along a first vertical direction and penetrating into the insulative cover, at least one soldering pad (63) extending laterally from the rectangular portion, and at least one teared portion (64) bending from the rectangular portion towards a second vertical direction opposite to the first vertical direction.

17 Claims, 5 Drawing Sheets

WATERPROOF ELECTRICAL CONNECTOR

BACKGROUND OF THE INVENTION

1. Field of the Invention

The present invention relates generally to an electrical connector, and more particularly to a waterproof electrical connector securely fixed to a printed circuit board.

2. Description of Related Arts

Universal Serial Bus (USB) interfaces are widely used in various electronic devices. In recent years, a micro USB interface is introduced to meet miniaturization requirement of electronic devices. Taiwan Utility Model No. M411033 discloses an electrical connector comprising a metallic shell, an insulating housing assembled to the metallic shell, and a plurality of terminals retained in the insulating housing. The insulating housing has a base portion and a tongue portion extending forwardly from the base portion. The tongue portion has an end surface and a receiving space recessed inwardly from the end surface. Each terminal has a contacting portion which is exposed in the receiving space. The electrical connector further has a sealing ring which is set on the end surface, in order to protect the electrical connector against dust and water. However, the connection between the electrical connector and a printed circuit board on which the electrical connector is mounted is achieved only by soldering the tail portions of the terminals to the printed circuit board, which is apt to damage. The sealing ring also is apt to dislodge from the end surface when the electrical connector is frequently used.

PCT Publication No. WO 2011/108679 discloses an electrical connector comprising a metallic shell mounted inside a housing and a sealing material provided along the outer circumference of the housing at a position close to an end section toward the connection terminal insertion side of the housing in order that water can be prevented from permeating deeply between a case and the connector. The metallic shell has a pair of fixing legs positioning into a printed circuit board. Because the fixing legs of the metal shell and a plurality of soldering portions of the contacts are both located similarly along a straight line at a rear side of the connector, the front side of the connector is very unsteady with respect to the printed circuit board.

An electrical connector that can be securely fixed to a printed circuit board and effectively prevent water from entering is desired.

SUMMARY OF THE INVENTION

Accordingly, an object of the present invention is to provide an electrical connector securely fixed to a printed circuit board and effectively preventing water from entering.

To achieve the above object, an electrical connector includes a metallic shell, an insulative housing combined to the metallic shell, a plurality of terminals retained in the insulative housing, an insulative cover covering the metallic shell, a waterproof ring and a waterproof plate respectively attached to a front end and a rear face of the insulative cover, and a fixing member attached to the insulative cover. The fixing member includes a rectangular portion, at least one corner portion bending from the rectangular portion along a first vertical direction and penetrating into the insulative cover, at least one soldering pad extending laterally from the rectangular portion, and at least one teared portion bending from the rectangular portion towards a second vertical direction opposite to the first vertical direction.

Other objects, advantages and novel features of the invention will become more apparent from the following detailed description when taken in conjunction with the accompanying drawings.

DETAILED DESCRIPTION OF THE PREFERRED EMBODIMENT

Figure 1:
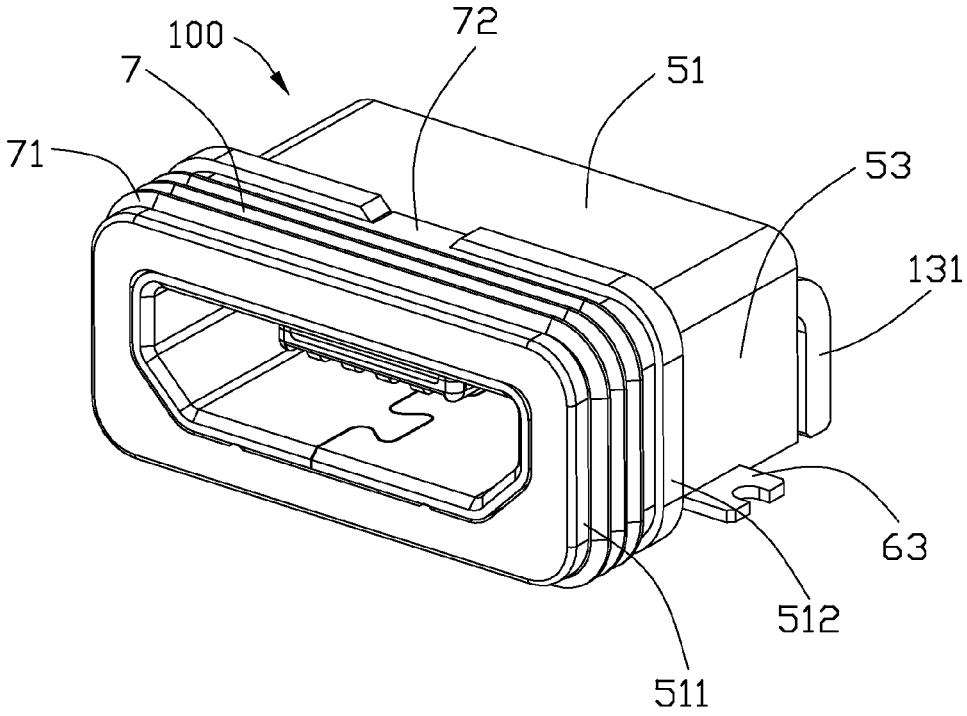
FIG. 1 is a perspective, assembled view of an electrical connector of the present invention.

Reference will now be made in detail to the preferred embodiment of the present invention.

Referring to FIGS. 1 to 5, an electrical connector 100 of the present invention comprises a metallic shell 1, an insulating housing 2 combined to the metallic shell 1, a plurality of terminals 3 and a metal plate 4 retained in the insulating housing 2, an insulative cover 5 covering the metallic shell 1, a metal fixing member 6 attached to a bottom face of the insulative cover 5, a waterproof ring 7 encircling a front end of the insulative cover 5, and a waterproof plate 8, which is an epoxy coating in this embodiment, attached to a rear face of the insulative cover 5. The nouns of locality "bottom, front, rear" are not meant to be limiting but are descriptive of depiction according to the claims.

Figure 2:
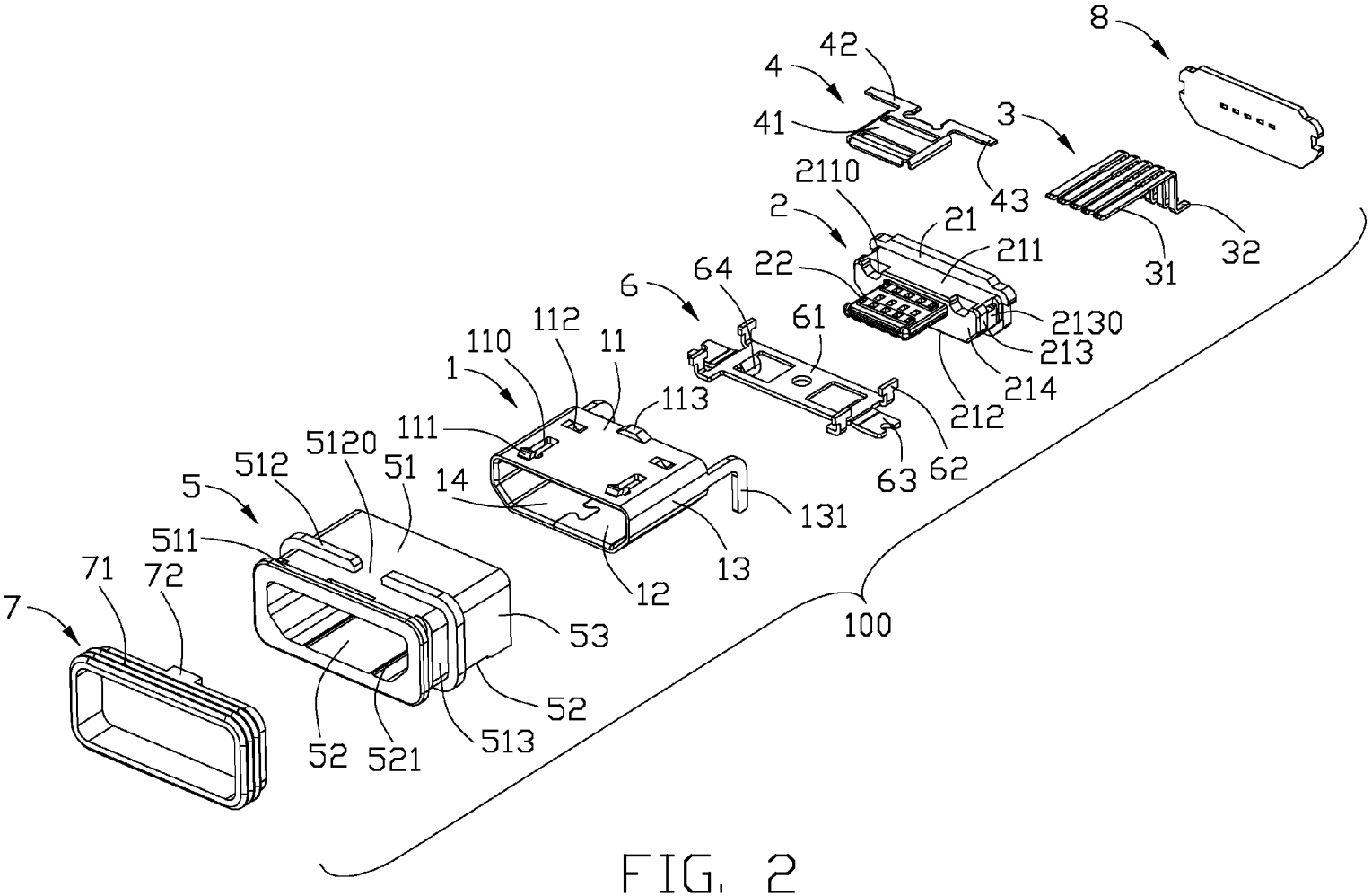
FIG. 2 is a perspective, exploded view of the electrical connector.
Figure 3:
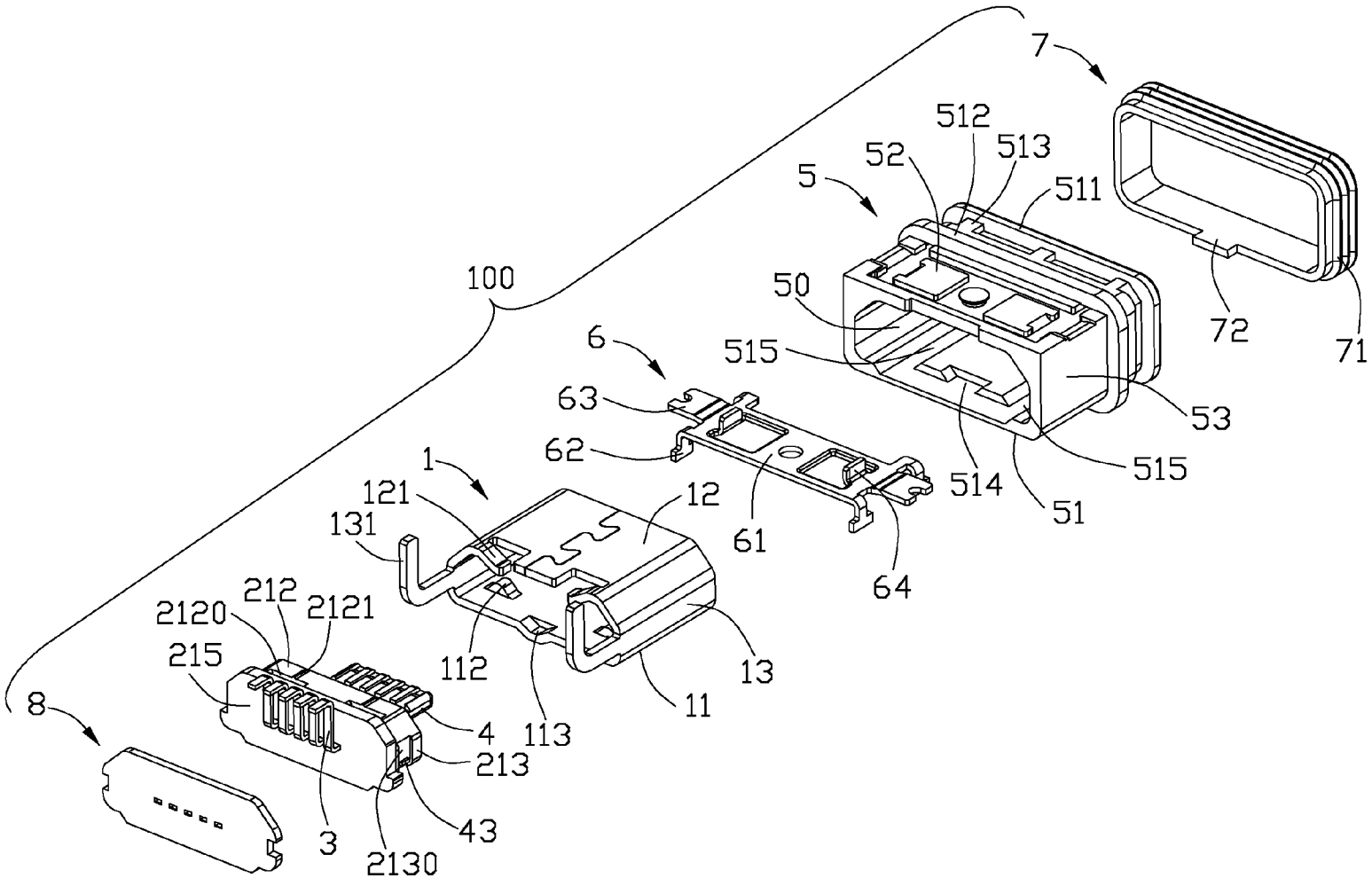
FIG. 3 is a perspective, exploded view of the electrical connector taken a different view with respect to FIG. 2.
Figure 4:
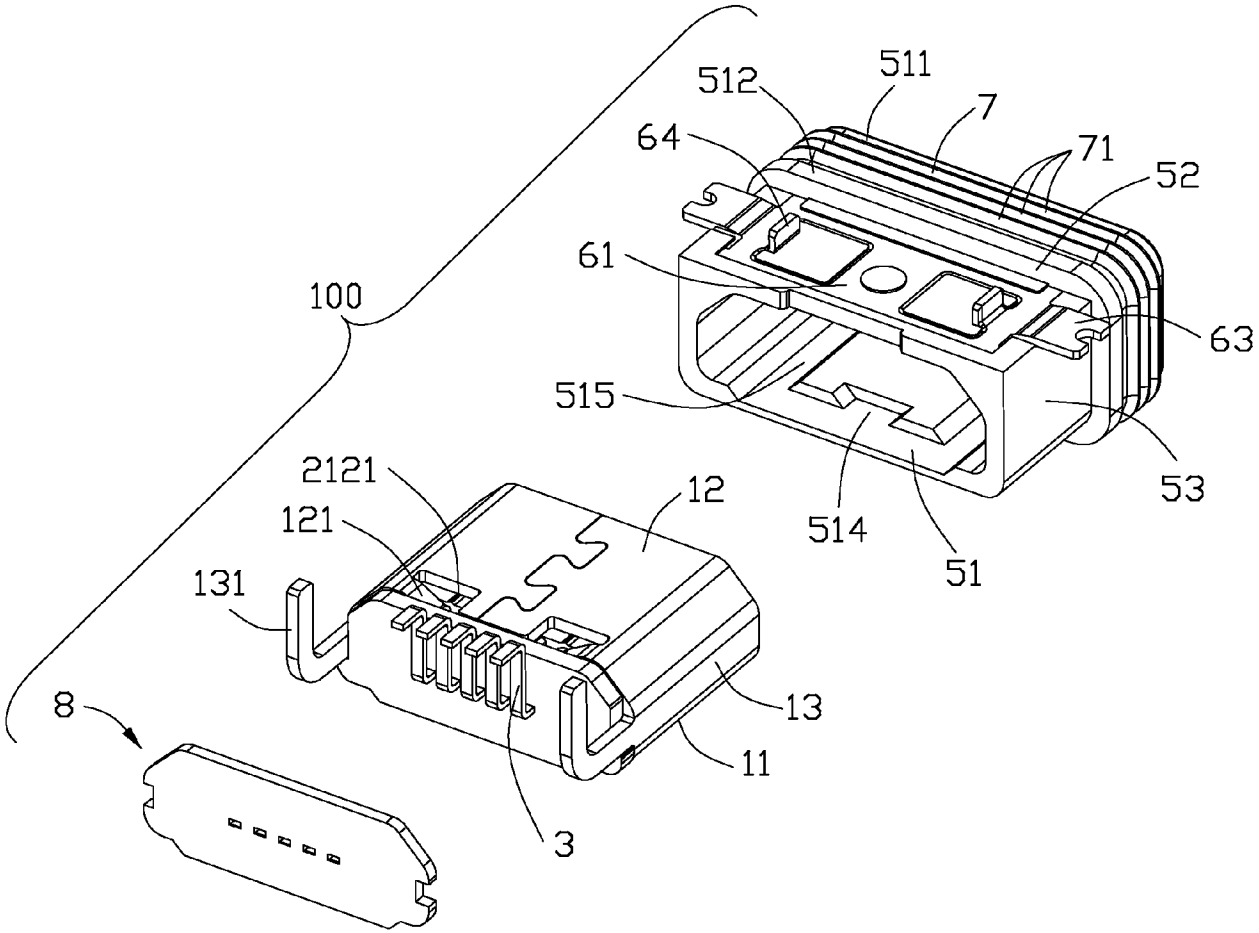
FIG. 4 is a perspective, partly assembled view of the electrical connector taken a same view as FIG. 3.

Referring to FIGS. 2 to 4, the metallic shell 1 comprises a top wall 11, a bottom wall 12, and a pair of lateral walls 13 connecting with the top wall 11 and the bottom wall 12 for cooperatively defining a receiving room 14 in which a mating connector (not shown) is inserted along a mating direction. The metallic shell 1 forms a pair of fixing legs 131 extending backwardly, downwardly from the lateral walls 13 for securing the metallic shell 1 on a printed circuit board (not shown). The top wall 11 defines a pair of apertures 110 at a front part thereof The top wall 11 forms a protrusion 111 at a front end of each aperture 110. The top wall 11 forms a pair of locking pieces 112 at a rear part thereof. The locking pieces 112 protrude into the receiving room 14. Lines defined between each two apertures 110, protrusions 111, and locking pieces 112 are parallel along a transverse direction perpendicular to the mating direction. The top wall 11 forms a bulge 113 at a rear edge thereof. The bulge 113 is located between the locking pieces 112. The bottom wall 12 forms a pair of fixing pieces 121 towards the locking pieces 112 at a rear part thereof and therefore, the fixing pieces 121 protrude into the receiving room 14, too.

Referring to FIGS. 2 to 4, the insulating housing 2 comprises a base portion 21 and a tongue portion 22 extending from the base portion 21 and forwardly into the receiving room 14 of the metallic shell 1. The base portion 21 has an upper surface 211, a lower surface 212, a pair of side surfaces 213, a front surface 214, and a rear surface 215. The lower surface 212 is located opposite to the upper surface 211 and the rear surface 215 is located opposite to the front surface 214. The side surfaces 213, the front surface 214, and the rear surface 215 vertically connect with the upper surface 211 and the lower surface 212. The upper surface 211 defines a pair of notches 2110 adjacent to the front surface 214. The locking pieces 112 are received in the notches 2110 for securing the metallic shell 1 and the insulating housing 2. The lower surface 212 defines a pair of slots 2120. The fixing pieces 121 are received in the slots 2120 for securing the metallic shell 1 and the insulating housing 2. Each side surface 213 defines a recess 2130. The lower surface 212 has a pair of ribs 2121 protruding from the corresponding slots 2120 towards the front surface 214. The ribs 2121 extend along the mating direction while the slots 2120 extend along the transverse direction. The ribs 2121 interfere with the inner face of the top wall 11 of the metallic shell 1 for securing the metallic shell 1 with the insulative housing 2. In detail, because manufacturing mirror may occurs, the ribs 2121 interfere with the inner face of the top wall 11 of the metallic shell 1 for preventing the metallic shell 1 from loosing away from the insulative housing 2. The ribs 2121 may be also formed on the upper surface 211, the side surfaces 213, any one of the surfaces of the insulating housing 2 that interfere with the metallic shell 1. The number of the ribs 2121 is changeable, too, according to a manufacturer's requirement.

Referring to FIGS. 2 and 3, the terminals 3 are insert-molded in the insulating housing 2. The terminals 3 comprise a plurality of contacting portions 31 extending beyond the tongue portion 22 and extending into the receiving room 14 for connecting with the mating connector and a plurality of soldering portions 32 extending out of the rear surface 215 of the insulating housing 2 for soldering with the printed circuit board.

Referring to FIGS. 2 and 3, the metal plate 4 is insert-molded in the insulating housing 2 for reinforcing rigidity of the insulative housing 2. The metal plate 4 comprises a main portion 41 retained with the tongue portion 22, a pair of curved portions 42 extending rearwardly and then oppositely, laterally from the main portion 41, and a pair of positioning end portions 43 formed at two distal ends of the curved portions 42. The positioning end portions 43 are received in the recesses 2130 of the base portion 21. Each length of the positioning end portion 43 is smaller than a depth of each corresponding recess 2130 and therefore, the positioning end portions 43 don't extend out of the recesses 2130 such that the positioning end portions 43 don't interfere with the side surfaces 13 of the metallic shell 1.

Referring to FIGS. 2 and 3, the insulative cover 5 is substantially tube-shaped for defining a receiving space 50 cooperatively receiving the insulating housing 2 and the metallic shell 1. The insulative cover 5 comprises a top plate 51, a bottom plate 52, and a pair of side plates 53 connecting with the top plate 51 and the bottom plate 52. The top plate 51, the bottom plate 52, and the side plates 53 are sealed for preventing water or etc from entering into the receiving space 50. The insulative cover 5 forms a first circular block portion 511 and a second circular block portion 512 spaced a distance away from the first circular block portion 511, both protruding from a front side thereof. A concaved portion 513 is defined between the first circular block portion 511 and the second circular block portion 512 for positioning the waterproof ring 7. The second circular block portion 512 defines a cutout 5120 for directing the waterproof ring 7.

Figure 5:
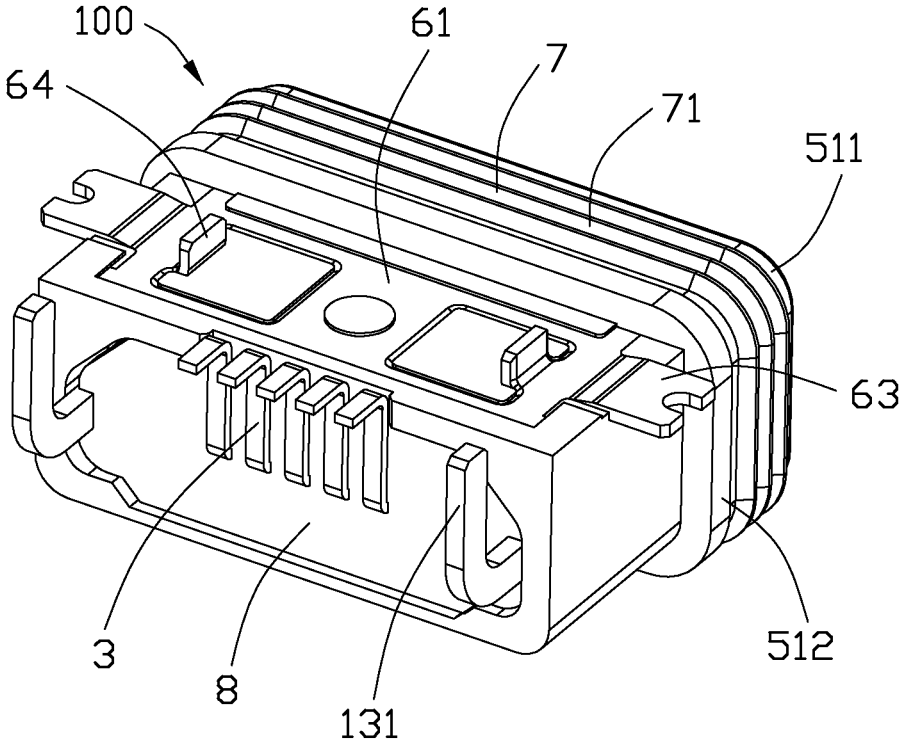
FIG. 5 is another perspective, assembled view of the electrical connector but taken a different view with respect to FIG. 1.

Referring to FIGS. 4 and 5, the top plate 51 of the insulative cover 5 defines a pair of channels 515 for correspondingly receiving the protrusions 111 of the metallic shell 1 and a depressed portion 514 for corresponding receiving the bulge 113 of the metallic shell 1 at an inner face thereof. The depressed portion 514 is located between the pair of channels 515. The bottom plate 52 forms a pair of ridges 521 at an inner face thereof The ridges 521 of the insulative cover 5 interfere with an outer face of the bottom wall 12 of the metallic shell 1 for preventing the insulative cover 5 from loosing from the metallic shell 1. The ridges 521 may be also formed on the top plate 51, the side plates 53, any one of the inner faces of the insulative cover 5 that interfere with the metallic shell 1. The number of the ridges 521 is changeable, too, according to a manufacturer's requirement.

Referring to FIGS. 2 to 4, the fixing member 6 is made by stamping and then bending from a metal piece. The fixing member 6 comprises a rectangular portion 61, a number of corner portions 62 bending from four corners of the rectangular portion 61 along a first vertical direction perpendicular to both the mating direction and the transverse direction, a pair of soldering pads 63 extending laterally from two opposite edges of the rectangular portion 61, and a pair of teared portions 64 bending from the rectangular portion 61 towards a second vertical direction opposite to the first vertical direction, so perpendicular to the mating direction and the transverse direction, too. The soldering pads 63 are positioned between each two corner portions 62 at a same side of the rectangular portion 61. The teared portions 64 are located back-to-back with respective to the adjacent soldering pads 63. The numbers and locations of the corner portions 62, the teared portions 64 are changeable, too, according to a manufacturer's requirement.

Referring to FIGS. 2 to 4, the fixing member 6 is retained on the insulative cover 5 by inser-molding to make sure that the rectangular portion 61 is coplanar with the bottom plate 52 of the insulative cover 5. The corner portions 62 of the fixing member 6 penetrate into the insulative cover 5 from the bottom plate 52 and therefore, the fixing member 6 is secured with the insulative cover 5. The soldering pads 63 and the teared portions 64 are exposed below the bottom plate 52 of the insulative cover 5 for fixing to the printed circuit board.

Referring to FIGS. 1 to 5, the waterproof ring 7 is made from plastic material such as rubber. The waterproof ring 7 has a substantially circular shape. The waterproof ring 7 is positioned in the concaved portion 513 between the first circular block portion 511 and the second circular block portion 512. The waterproof ring 7 forms a plurality of tiny, circular, convex arrises 71 and therefore, a contacting area between the waterproof ring 7 and an electronic device that the electrical connector 100 is assembled is enlarged for sealing purpose. Each arris 71 is the same to another and therefore, the convex arrises 71 are combined to be the waterproof ring 7. The waterproof ring 7 has a guiding portion 72 protruding laterally therefrom for engaging with the cutout 5120 of the insulative cover 5. Therefore, the waterproof ring 7 is oriented relative to the insulative cover 5 for preventing the waterproof ring 7 from rotating or moving away from its correct position under an unexpected force which may induce that the waterproof effect of the ring 7 is not achieved.

Referring to FIGS. 3 to 5, the waterproof plate 8 is attached to the rear face of the insulative cover 5 except that the fixing legs 131 of the metallic shell 1 and the soldering portions 32 of the terminals 3 extend out of the waterproof plate 8. Glutinous material is filled between the waterproof plate 8 and the insulative cover 5 for better waterproof purpose.

The electrical connector 100 of the present invention comprises the insulative cover 5, the waterproof ring 7, and the waterproof plate 8 cooperatively covering the metallic shell 1 and preventing water or etc from entering into the metallic shell 1. The electrical connector 100 has a perfect waterproof effect thereafter. The fixing member 6 helps the electrical connector 100 of the present invention to be assembled on the printed circuit board to make sure the electrical connector 100 does not easily disengage away from the printed circuit board.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

a metallic shell;

an insulative housing combined to the metallic shell;

a plurality of terminals retained in the insulative housing;

an insulative cover receiving the combined metallic shell and insulative housing;

a waterproof ring and a waterproof plate respectively provided at a front end and a rear face of the insulative cover; and a fixing member attached to the insulative cover and having a rectangular portion, at least one corner portion bent from the rectangular portion along a first vertical direction and penetrating into the insulative cover, at least one soldering pad extending laterally from the rectangular portion, and at least one teared portion bent from the rectangular portion towards a second opposite vertical direction.

2. The electrical connector as claimed in claim 1, wherein the insulative cover has a bottom surface facing a printed circuit board and the rectangular portion of the fixing member is coplanar with the bottom surface of the insulative cover.

3. The electrical connector as claimed in claim 1, wherein the fixing member has four corner portions located at four corners of the rectangular portion, a pair of soldering pads each positioned between each two corner portions at a same side of the rectangular portion, and a pair of teared portions each located back-to-back with respect to the adjacent soldering pads.

4. The electrical connector as claimed in claim 1, wherein the metallic shell forms a pair of protrusions and a bulge on an outer face thereof and the insulative cover defines a pair of channels receiving the protrusions and a depressed portion at an inner face thereof receiving the bulge.

5. The electrical connector as claimed in claim 1, wherein the insulative cover forms a ridge at another inner face thereof fitting with another outer face of the metallic shell.

6. The electrical connector as claimed in claim 1, wherein the insulative cover has a first circular block portion and a second circular block portion spaced a distance from the first circular block portion to define a concaved portion, and the waterproof ring is positioned in the concaved portion.

7. The electrical connector as claimed in claim 6, wherein the second circular block portion defines a cutout and the waterproof ring has a guiding portion engaging with the cutout.

8. The electrical connector as claimed in claim 1, further comprising a glutinous material filled between the waterproof plate and the insulative cover.

9. The electrical connector as claimed in claim 8, wherein the terminals comprise a plurality soldering portions, the metallic shell comprises a pair of fixing legs, and the soldering portions and the fixing legs extend outside of the waterproof plate.

10. An electrical connector for mounting to a printed circuit board, comprising:

an insulative housing defining a base and a mating tongue unitarily extending forwardly therefrom in a front-to-back direction;

a plurality of contact disposed in the housing with front contacting sections exposed upon the mating tongue and rear mounting sections exposed outside of a rear face of the housing for mounting to the printed circuit board;

a metallic shell discrete from and assembled to the housing and circumferentially enclosing the mating tongue and a front portion of the base, said shell and said housing being configured to allow said shell to be only rearwardly assembled to the housing in said front-to-back direction;

an insulative cover discrete from and assembled to the shell and circumferentially enclosing the shell and a rear portion of the base, said cover and said shell being configured to allow said cover to be only rearwardly assembled to the shell in said front-to-back direction; and a metallic fixing member assembled with the cover for confronting the printed circuit board, said fixing member defining an upper connecting segment to secure to the cover, and a mounting segment for mounting to the printed circuit board in front of the rear mounting sections of the contacts.

11. The electrical connector as claimed in claim 10, wherein said shell further includes protrusions located behind the cover for mounting to the printed circuit board.

12. The electrical connector as claimed in claim 10, further including an epoxy plate located between the rear face of the housing and vertically extending sections of the rear mounting sections of the contacts.

13. The electrical connector as claimed in claim 10, further including a metallic reinforcement plate integrally formed with the housing to covering one face of the mating tongue, wherein said metallic reinforcement plate defines a positioning end confronting the metallic shell directly.

14. The electrical connector as claimed in claim 10, wherein the fixing member is configured to be assembled to the cover via an insert molding way for assuring securement therebewteen, and said fixing member defines a rectangular plate extending with essentially a full dimension of the cover in a transverse direction perpendicular to said front-to-back direction.

15. The electrical connector as claimed in claim 14, wherein the mounting segment of said fixing member includes a horizontal part and a vertical part spaced from each other in a transverse direction perpendicular to said front-to-back direction.

16. The electrical connector as claimed in claim 10, wherein said shell defines an inward and downward protrusion direction for engagement with the housing, and an outward and upward protrusion for engagement with the cover.

17. The electrical connector as claimed in claim 10, wherein a sealing ring structure is disposed upon a front portion of exterior surfaces of the cover while the fixing member is located on a rear portion of one of said exterior surfaces of the cover.

* * * * *